United States Patent [19]

Andersson

[11] Patent Number: 4,483,034

[45] Date of Patent: Nov. 20, 1984

[54] APPARATUS FOR ABSORBING LIQUID FROM A SURFACE

[76] Inventor: Ruben J. Andersson, PL 1142, S-832 00, Frösön, Sweden

[21] Appl. No.: 586,788

[22] Filed: Mar. 6, 1984

[30] Foreign Application Priority Data

Mar. 11, 1983 [SE] Sweden ..... 8301321

[51] Int. Cl.[3] ..... F01H 1/12

[52] U.S. Cl. ..... 15/119 A; 15/98

[58] Field of Search ..... 15/97 R, 98, 116 A, 15/119 A, 244 R, 244 A

[56] References Cited

FOREIGN PATENT DOCUMENTS 2855474 7/1979 Fed. Rep. of Germany ..... 15/98

*Primary Examiner*—Edward L. Roberts

*Attorney, Agent, or Firm*—Young & Thompson

[57] ABSTRACT

An apparatus for absorbing liquid such as water from a surface such as the ground comprises a compressible, absorbant body. According to the invention the absorbant body comprises a plurality of circular discs of absorbant material, each pair of adjacent discs being sealed off from each other by means of an interposed foil such as a plastics foil so that upon compression of the body each disc will discharge its liquid such as water at the edge portion of the disc.

1 Claim, 4 Drawing Figures

APPARATUS FOR ABSORBING LIQUID FROM A SURFACE

The present invention relates to apparatus for absorbing liquid from surfaces.

The apparatus to be described is particularly, but not exclusively, suitable for removing excess rainwater from tennis courts, roads and the like.

The present invention provides an apparatus for absorbing liquid from a surface, said apparatus comprising a substantially cylindrical, resiliently compressible, absorbant body mounted to an axial through shaft for rolling motion over a surface with the shaft substantially horizontal, end plates disposed on the shaft at either end face of the body, said plates having a diameter less than the diameter of the cylindrical body but greater than half thereof, a bearing sleeve mounted on each end of the shaft, each sleeve carrying an arm, which arms cross at a pivot point to form tongs, operation of which causes one of the bearing sleeves to move axially of the shaft with its associated end plate to compress the body, and an axle carrying two wheels mounted to one of the arms adjacent to and parallel with one end face of the body such that the apparatus may be transported on said wheels with the shaft substantially vertical, wherein the absorbant body comprises a plurality of circular discs of absorbant material, each pair of adjacent discs being sealed off from each other by means of an interposed sealing foil such as a plastics foil so that upon compression of the body each disc will discharge its water at the edge portion of the disc.

In order that the invention may be well understood an embodiment thereof will now be described, by way of example only, with reference to the accompanying drawings in which.

Figure 1:
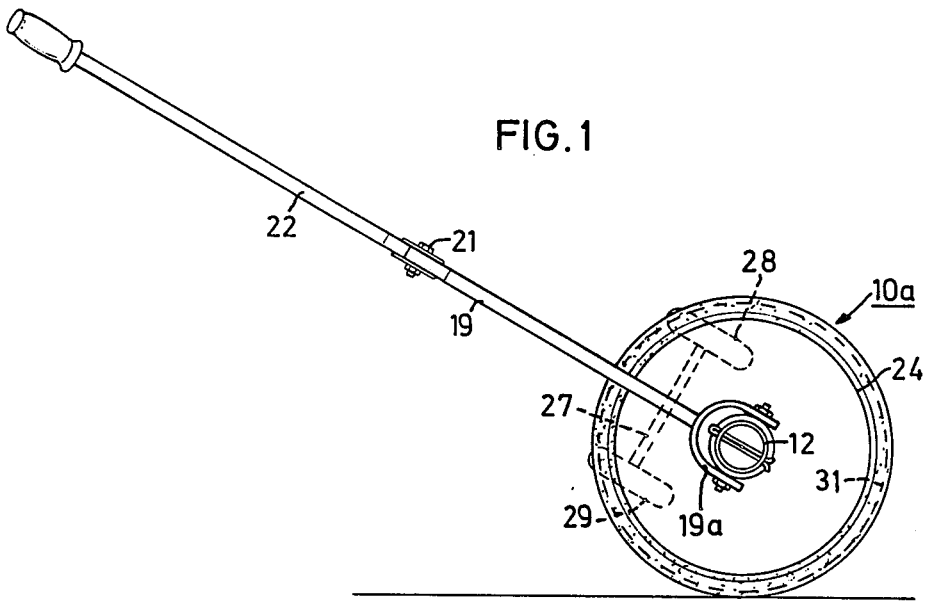
FIG. 1 is a side-view of the apparatus in a working attitude.
Figure 2:
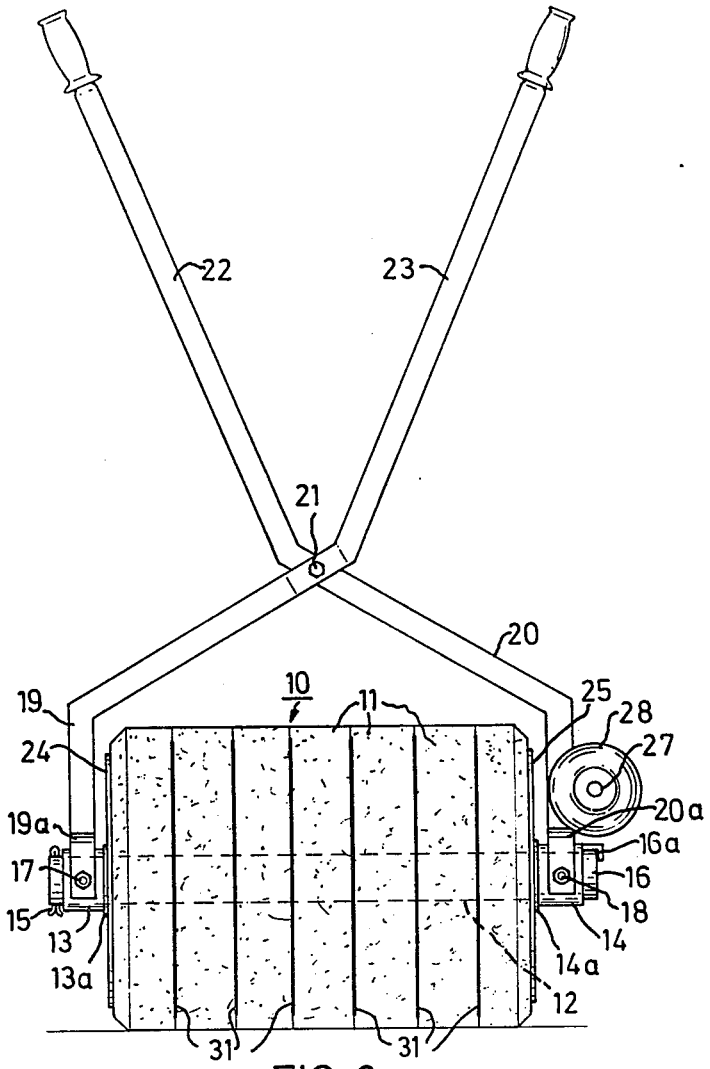
FIG. 2 is a front view of the apparatus in FIG. 1.

As shown in FIGS. 1 and 2, a substantially cylindrical absorbant body 10 consists of a plurality of discs 11 made from cellular plastics, foam rubber or similar resiliently compressible, water-absorbing material. Each disc 11 is provided with a central through-hole for receiving an axial through shaft 12. In the example shown, the diameter of the shaft is approximately a sixth of the diameter of the cylindrical body. The shaft 12 should preferably have a diameter which is not greater than about a fourth of that of the cylindrical body. The purpose of this is to obtain as great a volume of water-absorbing material as possible.

Figure 3:
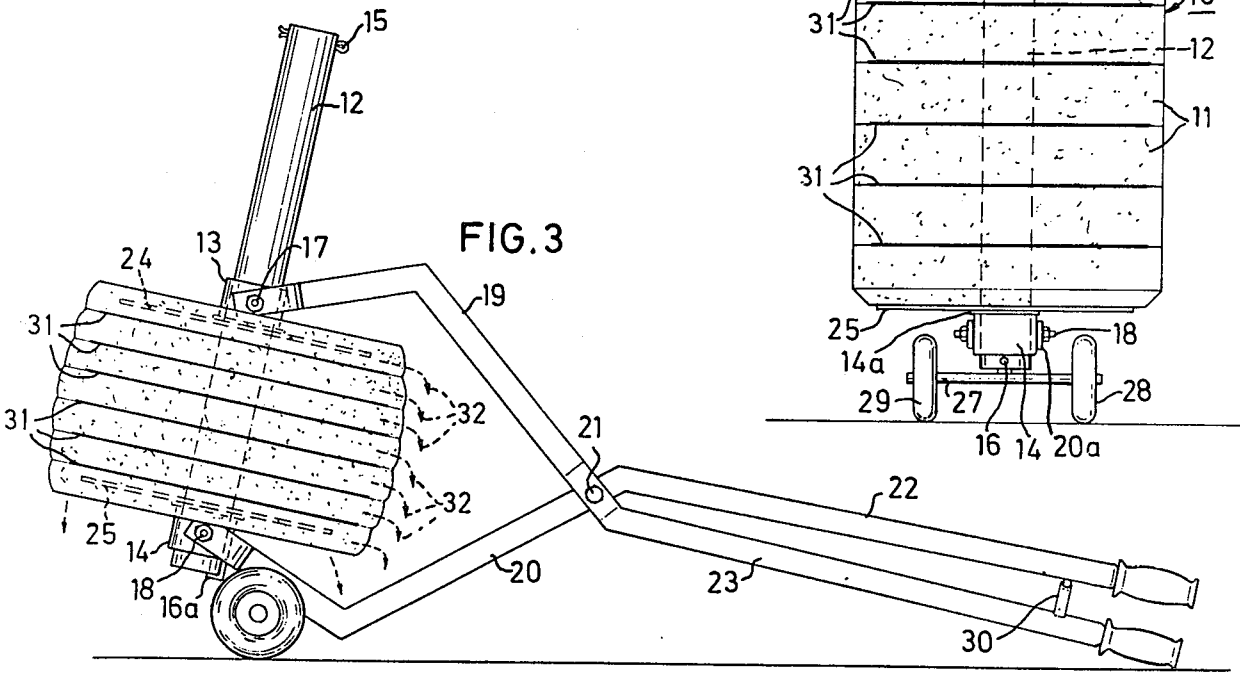
FIG. 3 shows the apparatus tipped up into an upright attitude, the cylindrical water-absorbing body having been compressed to remove water from it.

The cylindrical absorbant body is supported on the shaft 12, the ends of which are rotatably mounted in bearing sleeves 13,14 having outer end positions determined by stop means 15,16 at the ends of the shaft 12. At the inner ends of the sleeves there are rotatable pressure discs 13*a*, 14*a*. In the example shown, the sleeve 14 is kept in its outer position by a fitting 16*a* mounted about the end of the shaft 12. The sleeve 14 is thus fixed in a predetermined position on the shaft 12, whilst the sleeve 13 can be moved axially along the shaft as shown in FIG. 3.

Each bearing sleeve carries an arm 19,20 which are fixed together by a bolt 21 to define a pivot point intermediate their length. The two arms operate together to form tongs. The arms are pivotally connected to their respective bearing sleeves by means of a pin 17 or 18 passing through the sleeve and a fork-like end 19*a* or 20*a* of the associated arm. Each arm 19,20 has a handle portion 22,23 beyond the pivot point opposite the absorbant body 10.

Two end plates 24,25 are rotatably mounted on the shaft 12. The end plates 24,25 are arranted between the pressure discs 13*a*, 14*a* of sleeves 13,14 and the end faces of the cylindrical body 10. The sleeves 13,14 and the pressure discs 13*a*,14*a* urge the end plates towards one another to compress the cylindrical body 10. As is apparent from FIG. 1, the end plates 24,25 comprise discs having a smaller outer diameter than that of the cylindrical body 10. However, the outer diameter of the discs is greater than half the diameter of the cylindrical body 10. After the cylindrical body has absorbed a certain amount of water it will be heavier, which in turn results in its being compressed in the region where it contacts the ground. Its rolling resistance is thus increased. Due to the preselected disc diameter, when the cylindrical body is in this state, the end plates 24,25 will have rolling ground contact and thereby take over the function of supporting the apparatus in continued rolling. This ground contact is also of importance as an indication that the cylindrical body has absorbed so much water that it is time to empty the water therefrom before the work of absorbing water is continued.

Figure 4:
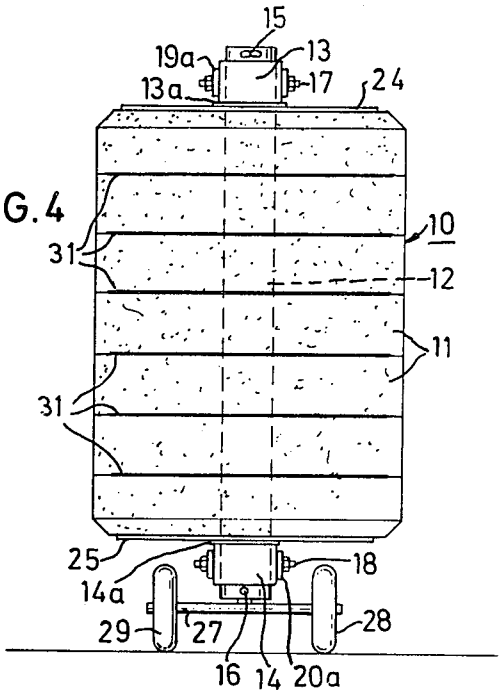
FIG. 4 shows the apparatus in an upright attitude with the cylindrical suction body in an uncompressed condition.

An axle 27 carrying two wheels 28 and 29 is mounted to the arm 20 adjacent to and parallel with the end face of the cylindrical absorbant body 10. The axle and wheels allow the apparatus to be transported on its side with the shaft disposed substantially vertically as in FIGS. 3 and 4. The axle 27 is disposed in such a position to allow wheels 28 and 29 to freely rotate without interfering with the cylindrical body during wheeled transport of the apparatus, or for the wheels to interfere with rolling movement of the cylindrical body or to make contact with the ground during water-absorbing operations.

The actual operation of the apparatus in absorbing water is extremely simple. While holding the handle portions 22,23 of the arms the cylindrical body is manoeuvred like a roller by driving it backwards and forwards in the collections of water to absorb such water. Since the cylindrical body has a relatively large volume relative to the diameter of the shaft 12, the former can attain a water-absorbing capacity of about 20 liters per minute with a manageably sized body 10. Such a rate must be regarded as satisfactory when the constructional simplicity of the apparatus is taken into consideration.

In order to empty the cylindrical body 10 of absorbed water, the apparatus is first tipped up onto its side in which position it is supported on wheels 28,29. The body 10 may then be compressed by bringing handle portions 22,23 of the arms together as shown in FIG. 3. This movement causes bearing sleeve 13 together with its pressure plate 13*a* and end plate 24 to move axially of shaft 12 towards fixed bearing sleeve 14, thus compressing the body 10 between end plates 24 and 25 and squeezing the water out. The length of arms 19 and 20 allows good leverage to be obtained to produce a high compression of the body 10 to exhaust all the absorbed water therefrom. The apparatus may be transported in a compressed condition by engaging a latch 30 for holding the handle portions together as shown in FIG. 3. The provision of the wheels 28,29 allows the apparatus to be transported relatively rapidly between a location where water is being absorbed and a suitable location for discharging said water.

As is apparent from FIGS. 1 and 2, the wheel axle 27 is in a plane substantially parallel to the end faces of the cylindrical body and is in a position on the same side of the shaft 12 as the pivot point 21 of the arms. This arrangement allows the apparatus to more or less balance when it is being transported on the carrying wheels 28,29 in the transporting attitude and emptying attitude according to FIGS. 3 and 4.

It will be appreciated that the above described apparatus is quickly and easily transported on its wheels 28 to and from the location where it is required. The apparatus is also simple to use and only requires one person to operate it. The arrangement of the apparatus is advantageous in that it is capable of absorbing a relatively large quantity of water and rapidly discharging it when required. Further, the construction of the apparatus is simple and inexpensive.

The discs 11 are sealed off from each other by means of plastics foils 31 interposed between each pair of adjacent discs. Upon compression of the discs as shown in FIG. 3, each disc will be compressed between two adjacent foils which prevent water to pass from the disc to the next disc below. Instead the water will be pressed radially outwards towards the edge portion of the disc and there leave the disc, as indicated by the arrows 32. Accordingly, by providing the sealing foils between the discs a more effective drying of the body will be obtained.

I claim:

1. An apparatus for absorbing liquid from a surface, said apparatus comprising a substantially cylindrical, resiliently compressible, absorbant body mounted to an axial through shaft for rolling motion over a surface with the shaft substantially horizontal, end plates disposed on the shaft at either end face of the body, said plates having a diameter less than the diameter of the cylindrical body but greater than half thereof, a bearing sleeve mounted on each end of the shaft, each sleeve carrying an arm, which arms cross at a pivot point to form tongs, operation of which causes one of the bearing sleeves to move axially of the shaft with its associated end plate to compress the body, and an axle carrying two wheels mounted to one of the arms adjacent to and parallel with one end face of the body such that the apparatus may be transported on said wheels with the shaft substantially vertical, characterized in that the absorbant body comprises a plurality of circular discs of absorbant material, each pair of adjacent discs being sealed off from each other by means of an interposed foil such as plastics foils so that upon compression of the body each disc will discharge its liquid such as water at the edge portion of the disc.

* * * * *